US009003828B2

(12) United States Patent
Bridgwood

(10) Patent No.: US 9,003,828 B2
(45) Date of Patent: Apr. 14, 2015

(54) METHOD AND SYSTEM FOR PRODUCTION OF LIQUID NATURAL GAS

(75) Inventor: Paul Bridgwood, Woodlands (AU)

(73) Assignee: LNG Technology Pty Ltd, West Perth (AU)

( * ) Notice: Subject to any disclaimer, the term of this patent is extended or adjusted under 35 U.S.C. 154(b) by 645 days.

(21) Appl. No.: 12/765,739

(22) Filed: Apr. 22, 2010

(65) Prior Publication Data

US 2010/0313597 A1 Dec. 16, 2010

Related U.S. Application Data

(63) Continuation-in-part of application No. 12/668,198, filed as application No. PCT/AU2008/001010 on Jul. 7, 2008.

(30) Foreign Application Priority Data

Jul. 9, 2007 (AU) ..... 2007903701

(51) Int. Cl.
*F25J 1/00* (2006.01)
*F25J 1/02* (2006.01)

(52) U.S. Cl.
CPC ..... *F25J 1/0022* (2013.01); *F25J 1/0025* (2013.01); *F25J 1/0042* (2013.01); *F25J 1/0052* (2013.01); *F25J 1/0212* (2013.01); *F25J 1/0227* (2013.01); *F25J 1/023* (2013.01); *F25J 1/0236* (2013.01);
(Continued)

(58) Field of Classification Search
USPC ..... 62/612, 613, 611, 614
See application file for complete search history.

(56) References Cited

U.S. PATENT DOCUMENTS 4,911,741 A * 3/1990 Davis et al. ..... 62/611
5,444,971 A * 8/1995 Holenberger ..... 60/783
(Continued)

FOREIGN PATENT DOCUMENTS

JP 2001132896 5/2001
JP 2005121183 5/2005
(Continued)

OTHER PUBLICATIONS

International Search Report from International Application No. PCT/AU2008/001010 filed Jul. 7, 2008 and published with Publication No. WO2009/006693 on Jan. 15, 2009.
(Continued)

*Primary Examiner* — Marc Norman
*Assistant Examiner* — Devon Russell
(74) *Attorney, Agent, or Firm* — Fitch, Even, Tabin & Flannery LLP

(57) ABSTRACT

A process and system for liquefying a hydrocarbon gas is provided. The hydrocarbon feed gas is pre-treated to remove sour species and water therefrom. The pre-treated feed gas is then passed to a refrigeration zone where it is cooled and expanded to produce a hydrocarbon liquid. A closed loop single mixed refrigerant provides most of the refrigeration to the refrigeration zone together with an auxiliary refrigeration system. The auxiliary refrigeration system and closed loop single mixed refrigerant are coupled in such a manner that waste heat generated by a gas turbine drive of the compressor in the closed loop single mixed refrigerant drives the auxiliary refrigeration system and the auxiliary refrigeration system cools the inlet air of the gas turbine. In this way, substantial improvements are made in the production capacity of the system.

29 Claims, 2 Drawing Sheets

(52) U.S. Cl.
CPC ..... *F25J 1/0242* (2013.01); *F25J 1/0283* (2013.01); *F25J 1/0294* (2013.01); *F25J 2205/66* (2013.01); *F25J 2210/06* (2013.01); *F25J 2220/62* (2013.01); *F25J 2220/64* (2013.01); *F25J 2220/66* (2013.01); *F25J 2240/70* (2013.01); *F25J 2240/82* (2013.01); *F25J 2245/90* (2013.01); *F25J 2260/30* (2013.01); *F25J 2270/906* (2013.01)

(56) References Cited

U.S. PATENT DOCUMENTS

| | | | | |
|---|---|---|---|---|
| 5,497,626 | A * | 3/1996 | Howard et al. | 62/612 |
| 5,790,972 | A * | 8/1998 | Kohlenberger | 701/103 |
| 6,457,315 | B1 * | 10/2002 | Lee et al. | 60/772 |
| 6,631,626 | B1 * | 10/2003 | Hahn | 62/612 |
| 7,165,422 | B2 | 1/2007 | Little | |
| 7,237,407 | B2 * | 7/2007 | Paradowski | 62/620 |
| 2007/0251266 | A1 * | 11/2007 | Ino et al. | 62/613 |
| 2007/0271936 | A1 * | 11/2007 | Wakamoto et al. | 62/160 |
| 2008/0202159 | A1 * | 8/2008 | Fountain | 62/612 |
| 2008/0276617 | A1 * | 11/2008 | Mak | 60/728 |
| 2009/0100844 | A1 * | 4/2009 | Rummelhoff | 62/48.2 |
| 2009/0217701 | A1 * | 9/2009 | Minta et al. | 62/612 |

FOREIGN PATENT DOCUMENTS

| | | |
|---|---|---|
| JP | 2005273681 | 10/2005 |
| WO | 2004065869 | 8/2004 |
| WO | WO 2004065869 A1 * | 8/2004 |
| WO | 2005047761 | 5/2005 |

OTHER PUBLICATIONS

International Search Report from International Application No. PCT/AU2008/001011 filed Jul. 9, 2008 and published with Publication No. WO2009/006694 on Jan. 15, 2009.

U.S. Appl. No. 12/668,200 (with Preliminary Amendment) filed Jan. 7, 2010.

Written Opinion of the International Searching Authority for PCT/AU2008/001011, dated Aug. 29, 2008.

Written Opinion of the International Searching Authority for PCT/AU2008/001010, dated Aug. 11, 2008.

* cited by examiner

Composite Cooling Curves

METHOD AND SYSTEM FOR PRODUCTION OF LIQUID NATURAL GAS

CROSS-REFERENCE TO RELATED APPLICATIONS

This application is a continuation-in-part of U.S. application Ser. No. 12/668,198, filed Jan. 7, 2010, which is the U.S. national phase application of International Application No. PCT/AU2008/001010, filed Jul. 7, 2008, which claims benefit from Australian Application No. AU2007903701, filed Jul. 9, 2007, all of which are hereby incorporated herein by reference in their entirety.

FIELD

The present invention relates to a method and system for production of liquid natural gas. In particular, the present invention relates to a process and system for liquefying a hydrocarbon gas, such as natural gas or coal seam gas.

BACKGROUND

The construction and operation of a plant for treating and liquefying a hydrocarbon gas, such as natural gas or coal seam gas, and produce liquefied methane or LNG involves vast capital and operational expenditure. In particular, with increased sensitivity to environmental issues and regulations pertaining to green house gas emissions, the design of such a plant must seek to incorporate features which increase fuel efficiency and reduce emissions where possible.

SUMMARY

In its broadest aspect, the invention provides a process and system for liquefying a hydrocarbon gas, such as natural gas or coal seam gas.

Accordingly, in a first aspect, the present invention provides a process for liquefying a hydrocarbon gas comprising the steps of:

a) providing a refrigeration zone, wherein refrigeration in the refrigeration zone is provided by circulating a mixed refrigerant from mixed refrigerant system and an auxiliary refrigerant from an auxiliary refrigeration system through the refrigeration zone;

b) coupling the mixed refrigerant system and the auxiliary refrigeration system in a manner whereby the auxiliary refrigeration system is driven, at least in part, by waste heat generated by the mixed refrigerant system; and c) passing the hydrocarbon gas through the refrigeration zone where the hydrocarbon gas is cooled and liquefied to produce a hydrocarbon liquid.

In one embodiment of the invention, the step of circulating a mixed refrigerant through the refrigeration zone comprises:

a) compressing the mixed refrigerant in a compressor;

b) passing the compressed mixed refrigerant through a first heat exchange pathway extending through the refrigeration zone where the compressed mixed refrigerant is cooled and expanded to produce a mixed refrigerant coolant;

c) passing the mixed refrigerant coolant through a second heat exchange pathway extending through the refrigeration zone to produce a mixed refrigerant; and d) recirculating the mixed refrigerant to the compressor.

In another embodiment of the invention, the step of passing the hydrocarbon gas through the refrigeration zone comprises passing the hydrocarbon gas through a third heat exchange pathway in the refrigeration zone.

In still another embodiment of the invention, the step of circulating the auxiliary refrigerant through the refrigeration zone comprises passing the auxiliary refrigerant through a fourth heat exchange pathway extending through a portion of the refrigeration zone. The second and fourth heat exchange pathways extend in counter current heat exchange relation to the first and third heat exchange pathways.

Advantageously, the inventors have discovered that heat produced in the compressing step by a gas turbine drive of the compressor, which would otherwise be considered as waste heat, can be utilised in the process to produce steam in a steam generator. The steam may be used to power a single steam turbine generator and produce electrical power which drives the auxiliary refrigeration system. Alternatively, the steam may be used in a steam turbine to drive one or more compressors in the auxiliary refrigeration system.

Accordingly, in a preferred embodiment of the invention, the process further comprises driving the auxiliary refrigeration system at least in part by waste heat produced from the compressing step of the process of the present invention.

In another preferred embodiment of the invention, the process further comprises cooling inlet air of a gas turbine directly coupled to the compressor with the auxiliary refrigerant. Preferably, the inlet air is cooled to about 5° C.-10° C. The inventors have estimated that cooling the inlet air of the gas turbine increases the compressor output by 15%-25%, thus improving the production capacity of the process since compressor output is proportional to LNG output.

In one embodiment of the invention, the step of compressing the mixed refrigerant increases the pressure thereof from about 30 to 50 bar.

When the mixed refrigerant is compressed its temperature rises. In a further embodiment, the process comprises cooling the compressed mixed refrigerant prior to passing the compressed mixed refrigerant to the first heat exchange pathway. In this way the cooling load on the refrigeration zone is reduced. In one embodiment, the compressed mixed refrigerant is cooled to a temperature less than 50° C. In the preferred embodiment, the compressed mixed refrigerant is cooled to about 10° C.

In another embodiment, the step of cooling the compressed mixed refrigerant comprises passing the compressed mixed refrigerant from the compressor to a heat exchanger, in particular an air- or water-cooler. In an alternative embodiment of the invention the cooling step comprises passing the compressed mixed refrigerant from the compressor to the heat exchanger as described above, and further passing the compressed mixed refrigerant cooled in the heat exchanger to a chiller. Preferably, the chiller is driven at least in part by waste heat, in particular waste heat produced from the compressing step.

In one embodiment of the invention, the temperature of the mixed refrigerant coolant is at or below the temperature at which the pre-treated feed gas condenses. Preferably the temperature of the mixed refrigerant coolant is less than −150° C.

In one embodiment of the invention, the mixed refrigerant contains compounds selected from a group consisting of nitrogen and hydrocarbons containing from 1 to 5 carbon atoms. Preferably, the mixed refrigerant comprises nitrogen, methane, ethane or ethylene, isobutane and/or n-butane. In one preferred embodiment the composition for the mixed refrigerant is as follows in the following mole fraction percent ranges: nitrogen: about 5 to about 15; methane: about 25 to about 35; C2: about 33 to about 42; C3: 0 to about 10; C4: 0 to about 20 about; and C5: 0 to about 20. The composition of the mixed refrigerant may be selected such that composite cooling and heating curves of the mixed refrigerant are matched within about 2° C. of one another, and that the composite cooling and heating curves are substantially continuous.

In one embodiment of the invention, the hydrocarbon gas is natural gas or coal seam methane. Preferably, the hydrocarbon gas is recovered from the refrigeration zone at a temperature at or below the liquefaction temperature of methane.

In a second aspect the invention provides a hydrocarbon gas liquefaction system comprising:

a) a mixed refrigerant;

b) a compressor for compressing the mixed refrigerant;

c) a refrigeration heat exchanger for cooling a hydrocarbon gas to produce a hydrocarbon liquid, the refrigeration heat exchanger having a first heat exchange pathway in fluid communication with the compressor, a second heat exchange pathway, and a third heat exchange pathway, the first, second and third heat exchange pathways extending through the refrigeration zone, and a fourth heat exchange pathway extending through a portion of the refrigeration zone, the second and fourth heat exchange pathways being positioned in counter current heat exchange in relation to the first and third heat exchange pathways;

an expander in fluid communication with an outlet from the first heat exchange pathway and an inlet to the second heat exchange pathway;

d) a recirculation mixed refrigerant line in fluid communication with an outlet from the second heat exchange pathway and an inlet to the compressor;

e) an auxiliary refrigeration system having an auxiliary refrigerant in fluid communication with the fourth heat exchange pathway;

f) a source of hydrocarbon gas in fluid communications with an inlet of the third heat exchange pathway; and g) a hydrocarbon liquid line in fluid communication with an outlet of the third heat exchange pathway.

In one embodiment of the invention, the compressor is a single stage compressor. Preferably, the compressor is a single stage centrifugal compressor driven directly (without gearbox) by a gas turbine. In an alternative embodiment, the compressor is a two stage compressor with intercooler and interstage scrubber, optionally provided with gearbox.

In another embodiment, the gas turbine is coupled with a steam generator in a configuration whereby, in use, waste heat from the gas turbine facilitates production of steam in the steam generator. In a further embodiment, the system comprises a single steam turbine generator configured to produce electrical power. Preferably, the amount of electrical power generated by the single steam turbine generator is sufficient to drive the auxiliary refrigeration system.

In an alternative embodiment, the steam generator is coupled with a steam turbine in an arrangement whereby the steam turbine drives one or more compressors in the auxiliary refrigeration system.

In another embodiment of the invention, the auxiliary refrigerant comprises low temperature ammonia and the auxiliary refrigeration system comprises one or more ammonia refrigeration packages. Preferably the one or more ammonia refrigeration packages are cooled by air coolers or water coolers.

In a preferred embodiment, the auxiliary refrigeration system is in heat exchange communication with the gas turbine, the heat exchange communication being configured in a manner to effect cooling of inlet air of the gas turbine by the auxiliary refrigeration system.

In a further embodiment of the invention, the system comprises a cooler to cool the compressed mixed refrigerant prior to the compressed mixed refrigerant being received in the refrigeration heat exchanger. Preferably the cooler is an air-cooled heat exchanger, or a water-cooled heat exchanger. In an alternative embodiment of the invention, the cooler further comprises a chiller in sequential combination with the air- or water-cooled heat exchanger. Preferably, the chiller is driven at least in part by waste heat produced from the compressor, in particular by waste heat produced from the gas turbine drive.

In a still further embodiment of the invention, the hydrocarbon liquid in the hydrocarbon liquid line is expanded through an expander to further cool the hydrocarbon liquid.

DESCRIPTION OF THE DRAWINGS

Preferred embodiments, incorporating all aspects of the invention, will now be described by way of example only with reference to the accompanying drawings, in which.

DETAILED DESCRIPTION OF PREFERRED EMBODIMENT

Figure 1:
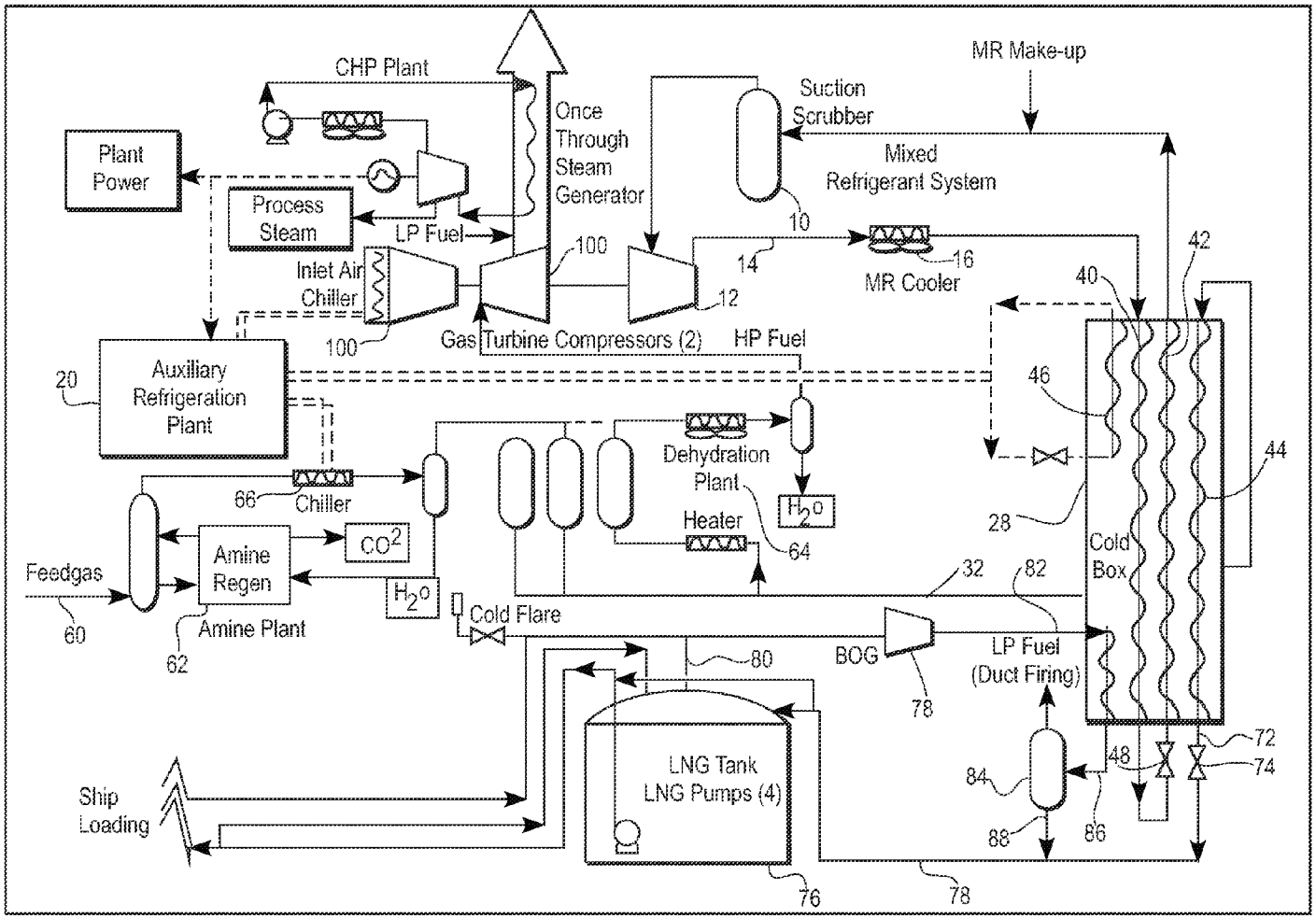
FIG. 1 is a schematic flow chart of a process for liquefying a fluid material, such as for example natural gas or CSG, in accordance with one embodiment of the present invention.

Referring to FIG. 1, there is shown a process for cooling a hydrocarbon gas to cryogenic temperatures for the purposes of liquefaction thereof. Illustrative examples of a hydrocarbon gas include, but are not limited to, natural gas and coal seam gas (CSG). While this specific embodiment of the invention is described in relation to the production of liquefied natural gas (LNG) from natural gas or CSG, it is envisaged that the process may be applied to other fluid materials which may be liquefied at cryogenic temperatures.

The production of LNG is broadly achieved by pre-treating a natural gas or CSG feed gas to remove water, carbon dioxide, and optionally other species which may solidify downstream at temperatures approaching liquefaction, and then cooling the pre-treated feed gas to cryogenic temperatures at which LNG is produced.

Referring to FIG. 1, the feed gas 60 enters the process at a controlled pressure of about 900 psi. Carbon dioxide is removed therefrom by passing it through a conventional packaged $CO_2$ stripping plant 62 where $CO_2$ is removed to about 50-150 ppm. Illustrative examples of a $CO_2$ stripping plant 62 include an amine package having an amine contactor (eg. MDEA) and an amine re-boiler. Typically, the gas exiting the amine contactor is saturated with water (eg. ~70 lb/MMscf). In order to remove the bulk of the water, the gas is cooled to near its hydrate point (eg. ~15° C.) with a chiller 66. Preferably, the chiller 66 utilises cooling capacity from an auxiliary refrigeration system 20. Condensed water is removed from the cooled gas stream and returns to the amine package for make-up.

Water must be removed from the cooled gas stream to ≤1 ppm prior to liquefaction to avoid freezing when the temperature of the gas stream is reduced to below hydrate freezing point. Accordingly, the cooled gas stream with reduced water content (e.g. ~20 lb/MMscf) is passed to a dehydration plant 64. The dehydration plant 64 comprises three molecular sieve vessels. Typically, two molecular sieve vessels will operate in adsorption mode while the third vessel is regenerated or in standby mode. A side stream of dry gas exiting the duty vessel is used for regeneration gas. Wet regeneration gas is cooled using air and condensed water is separated. The saturated gas stream is heated and used as fuel gas. Boil-off gas (BOG) is preferentially used as regeneration/fuel gas (as will be described later) and any shortfall is supplied from the dry gas stream. No recycle compressor is required for regeneration gas.

The feed gas 60 may optionally undergo further treatment to remove other sour species or the like, such as sulphur compounds, although it will be appreciated that many sulphur compounds may be removed concurrently with carbon dioxide in the $CO_2$ stripping plant 62.

As a result of pre-treatment, the feed gas 60 becomes heated to temperatures up to 50° C. In one embodiment of the present invention, the pre-treated feed gas may optionally be cooled with a chiller (not shown) to a temperature of about 10° C. to −50° C. Suitable examples of the chiller which may be employed in the process of the present invention include, but are not limited to, an ammonia absorption chiller, a lithium bromide absorption chiller, and the like, or the auxiliary refrigeration system 20.

Advantageously, depending on the composition of the feed gas, the chiller may condense heavy hydrocarbons in the pre-treated stream. These condensed components can either form an additional product stream, or may be used as a fuel gas or as a regeneration gas in various parts of the system.

Cooling the pre-treated gas stream has the primary advantage of significantly reducing the cooling load required for liquefaction, in some instances by as much as 30% when compared with the prior art.

The cooled pre-treated gas stream is supplied to a refrigeration zone 28 through line 32 where said stream is liquefied.

The refrigeration zone 28 comprises a refrigerated heat exchanger wherein refrigeration thereof is provided by a mixed refrigerant and an auxiliary refrigeration system 20. Preferably, the heat exchanger comprises brazed aluminium plate fin exchanger cores enclosed in a purged steel box.

The refrigerated heat exchanger has a first heat exchange pathway 40 in fluid communication with the compressor 12, a second heat exchange pathway 42, and a third heat exchange pathway 44. Each of the first, second and third heat exchange pathways 40, 42, 44 extend through the refrigerated heat exchanger as shown in FIG. 1. The refrigerated heat exchanger is also provided with a fourth heat exchange pathway 46 which extends through a portion of the refrigerated heat exchanger, in particular a cold portion thereof. The second and fourth heat exchange 42, 46 pathways are positioned in counter current heat exchange in relation to the first and third heat exchange pathways 40, 44.

Refrigeration is provided to the refrigeration zone 28 by circulating the mixed refrigerant therethrough. The mixed refrigerant from a refrigerant suction drum 10 is passed to the compressor 12. The compressor 12 is preferably two parallel single stage centrifugal compressors, each directly driven by gas turbines 100, in particular an aero-derivative gas turbine. Alternatively, the compressor 12 may be a two stage compressor with intercooler and interstage scrubber. Typically the compressor 12 is of a type which operates at an efficiency of about 75% to about 85%.

Waste heat from the gas turbines 100 may be used to generate steam which in turn is used to drive an electric generator (not shown). In this way, sufficient power may be generated to supply electricity to all the electrical components in the liquefaction plant, in particular the auxiliary refrigeration system 20.

Alternatively, the steam that is generated by waste heat from the gas turbines 100 may also be used to drive a steam turbine which is coupled with the auxiliary refrigeration system 20 to drive one or more compressors thereof (not shown).

Steam that is generated by waste heat from the gas turbines 100 may also be used to heat the amine re-boiler of the $CO_2$ stripping plant 62, for regeneration of the molecular sieves of the dehydration plant 64, regeneration gas and fuel gas.

The mixed refrigerant is compressed to a pressure ranging from about 30 bar to 50 bar and typically to a pressure of about 35 to about 40 bar. The temperature of the compressed mixed refrigerant rises as a consequence of compression in compressor 12 to a temperature ranging from about 120° C. to about 160° C. and typically to about 140° C.

The compressed mixed refrigerant is then passed through line 14 to a cooler 16 to reduce the temperature of the compressed mixed refrigerant to below 45° C. In one embodiment, the cooler 16 is an air-cooled fin tube heat exchanger, where the compressed mixed refrigerant is cooled by passing the compressed mixed refrigerant in counter current relationship with a fluid such as air, or the like. In an alternative embodiment, the cooler 16 is a shell and tube heat exchanger where the compressed mixed refrigerant is cooled by passing the compressed mixed refrigerant in counter current relationship with a fluid, such as water, or the like.

The cooled compressed mixed refrigerant is passed to the first heat exchange pathway 40 of the refrigeration zone 28 where it is further cooled and expanded via expander 48, preferably using a Joule-Thomson effect, thus providing cooling for the refrigeration zone 28 as mixed refrigerant coolant. The mixed refrigerant coolant is passed through the second heat exchange pathway 42 where it is heated in countercurrent heat exchange with the compressed mixed refrigerant and the pre-treated feed gas passing through the first and third heat exchange pathways 40, 44, respectively. The mixed refrigerant gas is then returned to the refrigerant suction drum 10 before entering the compressor 12, thus completing a closed loop single mixed refrigerant process.

Mixed refrigerant make-up is provided from the fluid material or boil-off gas (methane and/or C2-C5 hydrocarbons), nitrogen generator (nitrogen) with any one or more of the refrigerant components being sourced externally.

The mixed refrigerant contains compounds selected from a group consisting of nitrogen and hydrocarbons containing from 1 to about 5 carbon atoms. When the fluid material to be cooled is natural gas or coal seam gas, a suitable composition for the mixed refrigerant is as follows in the following mole fraction percent ranges: nitrogen: about 5 to about 15; methane: about 25 to about 35; C2: about 33 to about 42; C3: 0 to about 10; C4: 0 to about 20 about; and C5: 0 to about 20. In a preferred embodiment, the mixed refrigerant comprises nitrogen, methane, ethane or ethylene, and isobutane and/or n-butane.

Figure 2:
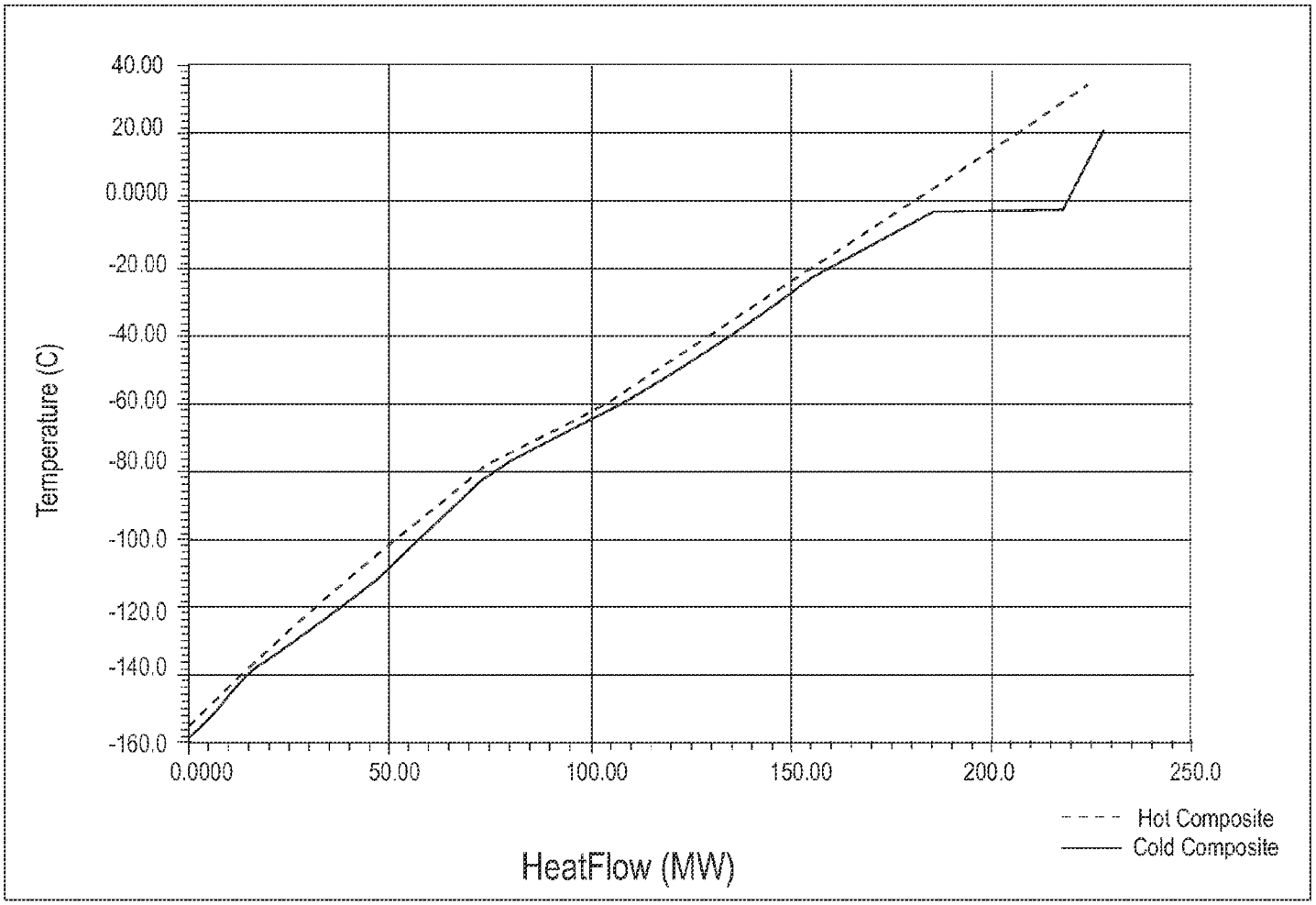
FIG. 2 is a composite cooling and heating curve for a single mixed refrigerant and the fluid material.

FIG. 2 shows a composite cooling and heating curve for the single mixed refrigerant and natural gas. The close proximity of the curves to within about 2° indicates the efficiencies of the process and system of the present invention.

Additional refrigeration may be provided to the refrigeration zone 28 by the auxiliary refrigeration system 20. The auxiliary refrigeration system 20 comprises one or more ammonia refrigeration packages cooled by air coolers. An auxiliary refrigerant, such as cool ammonia, passes through the fourth heat exchange pathway 44 located in a cold zone of the refrigeration zone 28. By this means, up to about 70% cooling capacity available from the auxiliary refrigeration system 20 may be directed to the refrigeration zone 28. The auxiliary cooling has the effect of producing an additional 20% LNG and also improves plant efficiency, for example fuel consumption in gas turbine 100 by a separate 20%

The auxiliary refrigeration system 20 utilises waste heat generated from hot exhaust gases from the gas turbine 100 to generate the refrigerant for the auxiliary refrigeration system 20. It will be appreciated, however, that additional waste heat generated by other components in the liquefaction plant may also be utilised to regenerate the refrigerant for the auxiliary refrigeration system 20, such as may be available as waste heat from other compressors, prime movers used in power generation, hot flare gases, waste gases or liquids, solar power and the like.

The auxiliary refrigeration system 20 is also used to cool the air inlet for gas turbine 100. Importantly, cooling the gas turbine inlet air adds 15-25% to the plant production capacity as compressor output is roughly proportional to LNG output.

The liquefied gas is recovered from the third heat exchange pathway 44 of the refrigeration zone 28 through a line 72 at a temperature from about −150° C. to about −170° C. The liquefied gas is then expanded through expander 74 which consequently reduces the temperature of the liquefied gas to about −160° C. Suitable examples of expanders which may be used in the present invention include, but are not limited to, expansion valves, JT valves, venturi devices, and a rotating mechanical expander.

The liquefied gas is then directed to storage tank 76 via line 78.

Boil-off gases (BOG) generated in the storage tank 76 can be charged to a compressor 78, preferably a low pressure compressor, via line 80. The compressed BOG is supplied to the refrigeration zone 28 through line 82 and is passed through a portion of the refrigeration zone 28 where said compressed BOG is cooled to a temperature from about −150° C. to about −170° C.

At these temperatures, a portion of the BOG is condensed to a liquid phase. In particular, the liquid phase of the cooled BOG largely comprises methane. Although the vapour phase of cooled BOG also comprises methane, relative to the liquid phase there is an increase in the concentration of nitrogen therein, typically from about 20% to about 60%. The resultant composition of said vapour phase is suitable for use as a fuel gas.

The resultant two-phase mixture is passed to a separator 84 via line 86, whereupon the separated liquid phase is redirected back to the storage tank 76 via line 88.

The cooled gas phase separated in the separator 84 is passed to a compressor, preferably a high pressure compressor, and is used in the plant as a fuel gas and/or regeneration gas via line.

Alternatively, the cooled gas phase separated in the separator 84 is suitable for use as a cooling medium to circulate through a cryogenic flowline system for transfer of cryogenic fluids, such as for example LNG or liquid methane from coal seam gas, from a storage tank 76 to a receiving/loading facility, in order to maintain the flowline system at or marginally above cryogenic temperatures.

Referring to FIG. 1, there is shown a main transfer line 92 and a vapour return line 94, both fluidly connecting storage tank 76 to a loading/receiving facility (not shown). Storage tank 76 is provided with a pump 96 for pumping LNG from storage tank 76 through the main transfer line 92.

As described previously, the cooled gas phase separated in the separator 85 is suitable for use as a cooling medium to circulate through a cryogenic flowline system for transfer of cryogenic liquids. Accordingly, the cooled gas phase separated in the separator 85 is directed via line 98 to the main transfer line 92, whereupon the cooled gas phase is circulated through the main transfer line 92 and the vapour return line 94 to maintain the cryogenic flowline system at a temperature at or marginally above cryogenic temperatures.

Preferably, the vapour return line 94 is fluidly connected to an inlet of the compressor 78 so that boil-off gases generated during transfer operations may be conveniently treated in accordance with the process for treating boil-off gases as outlined above.

Before transfer operations commence, it is envisaged that additional cooling and filling of the main transfer line 92 could be achieved by priming said line 92 by passing the liquid phase separated in separator 84 or liquid fluid material discharged from heat exchanger 28 through said line 92 via line 99. It is anticipated that any liquid phase remaining in the line 99 after completion of transfer operations could self-drain back into the storage tank 76 under inherent pressure self-generated in the line 99 from ambient heating.

The process and system described above has the following advantages over traditional LNG plants:

(1) Integrated combined heat and power technology systems (CHP) use waste heat from the gas turbines 100 plus some auxiliary firing with recovered boil-off gas (which is low Btu waste gas) to provide all heating requirements and electrical power via a steam turbine generator for the LNG plant. The waste heat is also used to drive standard packaged ammonia refrigeration compressors of the auxiliary refrigeration system 20 which provides additional refrigeration for:

gas turbine inlet air cooling, thereby improving plant capacity by 15-25%;

general process cooling, thereby reducing the size of the dehydration plant and balancing regeneration gas with the fuel gas required to power the gas turbines 100;

additional cooling for the refrigeration zone, thereby improving plant production capacity by up to 20% and energy efficiency by up to another 20%;

(2) The mixed refrigerant system is designed to provide a close match on the cooling curves thereby maximising refrigeration efficiency. Integration of the auxiliary refrigeration system 20 with the refrigeration zone 28 improves the heat transfer at the warm end of the heat exchanger by increasing the LMTD which reduces the size of the heat exchanger. This also provides a cool mixed refrigerant suction temperature to the compressor which significantly improves the compressor capacity.

(3) The high efficiency, use of CHP to meet all plant heat and electrical power requirements and the use of dry low emissions combustors in the gas turbines 100 results in very low overall emissions.

(4) Efficient BOG recovery. The system is configured to recover flash gas and BOG generated from the storage tank 76 and from the receiving/loading facility (eg. ships) during loading. The BOG gas is compressed in compressor 78 where it is re-liquefied in the refrigeration zone 28 to recover methane as liquid. The liquid methane is returned to the storage tank 26 and the flash gas which is concentrated in nitrogen is used to auxiliary fire the exhaust of the gas turbine 100. This is a cost effective and energy efficient way of dealing with BOG and rejecting nitrogen from the system, and at the same time minimise or eliminate flaring during loading.

(5) Efficient transfer flowline system. The system is configured to provide a reduction in heat loss from the transfer lines and a concomitant reduction in BOG generated therein, a portion of which would be flared under prior art conditions. In the present invention, any BOG which is generated in the transfer flowlines may be recirculated to the compressor 78 and refrigeration zone 28 for liquefaction, and use as a cooling medium. Additionally, the process and system obviates the need for an additional transfer lines and associated pumps for circulation, thus reducing the capital expenditure of said system.

(6) Lower plant capital and operating/maintenance costs. Fewer equipment items and modular packages results in reduced civil, mechanical, piping, electrical and instrumentation works and a fast construction schedule; all of which contribute to reduced costs. This results in simple operations requiring less operating and maintenance staff.

It is to be understood that, although prior art use and publications may be referred to herein, such reference does not constitute an admission that any of these form a part of the common general knowledge in the art, in Australia or any other country.

For the purposes of this specification it will be clearly understood that the word "comprising" means "including but not limited to", and that the word "comprises" has a corresponding meaning.

Numerous variations and modifications will suggest themselves to persons skilled in the relevant art, in addition to those already described, without departing from the basic inventive concepts. All such variations and modifications are to be considered within the scope of the present invention, the nature of which is to be determined from the foregoing description.

The invention claimed is:

1. A process for liquefying a hydrocarbon gas comprising the steps of:

a) providing:

i. a single heat exchanger having a warm end and a cold end, said heat exchanger having a plurality of heat exchange pathways including three main heat exchange pathways extending from the warm end to the cold end of said heat exchanger and two minor heat exchange pathways, a first of the two minor heat exchange pathways extending through the warm end of said heat exchanger and a second of the two minor heat exchange pathways extending through the cold end of said heat exchanger;

ii. a closed loop mixed refrigerant system having a single stage centrifugal compressor driven directly by a gas turbine to produce a single mixed refigerant;

iii. an ammonia refrigeration system having an ammonia compressor to produce an ammonia refrigerant;

iv. a steam system comprising a steam turbine driven by a steam generator;

b) coupling said mixed refrigerant system, said ammonia refrigeration system and said steam system in a manner whereby the mixed refrigerant gas turbine produces waste heat, the steam generator utilizes the waste heat from the gas turbine to produce steam for the steam turbine to drive the ammonia compressor, and the ammonia compressor provides ammonia refigerant to cool the inlet air of the mixed refrigerant gas turbine;

c) passing the single mixed refrigerant through a first of the three main heat exchange pathways from the warm end to the cold end of the heat exchanger, expanding the single mixed refrigerant and passing the expanded single mixed refrigerant through the second of the three main heat exchange pathways from the cold end to the warm end of the heat exchanger in a counter-current flow direction to the flow of single mixed refrigerant in the first main heat exchange pathway to provide refrigeration to the heat exchanger; passing the ammonia refrigerant through the first minor heat exchange pathway in co-current flow direction to the flow of single mixed refrigerant to the single mixed refrigerant in the second main heat exchange pathway to provide additional refrigeration to the heat exchanger;

d) passing the hydrocarbon gas through the third of the three main heat exchange pathways of the heat exchanger from the warm end to the cold end in heat exchange proximity and counter-current flow direction to the single mixed refrigerant in the second main heat exchange pathway and the ammonia refrigerant in the first minor heat exchange pathway to produce a hydrocarbon liquid; and e) providing a vapour recovery system in fluid communication with a hydrocarbon liquid storage zone and said heat exchanger, the vapour recovery system having a compressor to receive and compress boil-off gas from said storage zone, and passing the compressed boil-off gas through the second of the two minor heat exchange pathways in heat exchange proximity and counter-current flow direction to the single mixed refrigerant in the second main heat exchange pathway to produce hydrocarbon liquid and a low pressure gas concentrated in nitrogen, the hydrocarbon liquid being subsequently returned to the storage zone.

2. The process according to claim 1, wherein prior to passing the mixed refrigerant through the heat exchanger the mixed refrigerant is compressed to about 30 to 50 bar in said compressor.

3. The process according to claim 1, further comprising utilizing said steam production in a steam turbine generator configured to produce electrical power.

4. The process according to claim 3, further comprising utilizing said electrical power to drive said refrigeration system.

5. The process according to claim 1, wherein the inlet air is cooled to a temperature in a range of about 5° C.-10° C.

6. The process according to claim 2, wherein the process comprises cooling the compressed mixed refrigerant prior to passing the compressed mixed refrigerant to the first main heat exchange pathway.

7. The process according to claim 6, wherein the compressed mixed refrigerant is cooled to a temperature less than 50° C.

8. The process according to claim 6, wherein the compressed mixed refrigerant is cooled to about 10° C.

9. The process according to claim 6, wherein the step of cooling the compressed mixed refrigerant comprises passing the compressed mixed refrigerant through a heat exchanger.

10. The process according to claim 9, wherein the heat exchanger is an air- or water-cooler.

11. The process according to claim 2, wherein the temperature of the mixed refrigerant in the second main heat exchange pathway in the cold end of said heat exchanger is at or below the temperature at which the hydrocarbon gas condenses.

12. The process according to claim 11, wherein the temperature of the mixed refrigerant is less than −150° C.

13. The process according to claim 1, wherein the mixed refrigerant contains compounds selected from a group consisting of nitrogen and hydrocarbons containing from 1 to 5 carbon atoms.

14. The process according to claim 13, wherein the mixed refrigerant comprises nitrogen, methane, ethane or ethylene, and isobutane and/or n-butane.

15. The process according to claim 13, wherein the composition of the mixed refrigerant is in the following mole fraction percent ranges: nitrogen: about 5 to about 15; methane: about 25 to about 35; C2: about 33 to about 42; C3: 0 to about 10; C4: 0 to about 20; and C5: 0 to about 20.

16. The process according to claim 1, wherein the hydrocarbon gas is natural gas or coal seam methane.

17. The process according to claim 16, wherein the hydrocarbon liquid is recovered from the heat exchanger at a temperature at or below the liquefaction temperature of methane.

18. A hydrocarbon gas liquefaction system comprising:

a) a single heat exchanger having a warm end and a cold end, said heat exchanger having a plurality of heat exchange pathways including three main heat exchange pathways extending from the warm end to the cold end of said heat exchanger and two minor heat exchange pathways, a first of the two minor heat exchange pathways extending through the warm end of said heat exchanger and a second of the two minor heat exchange pathways extending through the cold end of said heat exchanger;

b) a closed loop mixed refrigerant system having a single stage centrifugal compressor driven directly by a gas turbine to produce a single mixed refrigerant, a first recirculation line in fluid communication with an outlet of said compressor and an inlet to the first of the three main heat exchange pathways disposed at the warm end of said heat exchanger, and a second recirculation line in fluid communication with an inlet of said compressor and an outlet from the second of the three main heat exchange pathways disposed at the warm end of said heat exchanger;

c) an ammonia refrigeration system having an ammonia compressor to produce an ammonia refrigerant, wherein the ammonia refrigeration system is configured to circulate the ammonia refrigerant through the first minor heat exchange pathway in a co-current flow direction to a flow of mixed refrigerant through the second main heat exchange pathway;

d) a steam system comprising a steam turbine driven by a steam generator;

e) a source of hydrocarbon gas in fluid communication with an inlet of a third of the three main heat exchange pathways disposed at the warm end of said heat exchanger; and f) a hydrocarbon liquid line in fluid communication with an outlet of the third main heat exchange pathway disposed at the cold end of said heat exchanger, wherein said mixed refrigerant system, said ammonia refrigeration system and said steam system are coupled in a manner whereby the mixed refrigerant turbine produces waste heat, the steam generator utilizes waste heat from the gas turbine to produce steam for the steam turbine to drive the ammonia compressor, and the ammonia compressor provides ammonia refrigerant to cool the inlet air of the gas turbine;

g) said system further comprising a vapour recovery system in fluid communication with a hydrocarbon liquid storage zone and said heat exchanger, the vapour recovery system having a compressor to receive and compress boil-off gas from said storage zone, the arrangement being such that the compressed boil-off gas is cooled by passing the compressed boil-off gas through the second of the two minor heat exchange pathways in heat proximity and counter-current flow direction to the single mixed refrigerant in the second main heat exchange pathway to produce hydrocarbon liquid and a low pressure gas concentrated in nitrogen, the hydrocarbon liquid being subsequently returned to the storage zone.

19. The system according to claim 18, wherein the steam generator is coupled to a single steam turbine generator configured to produce electrical power.

20. The system according to claim 19, wherein the amount of electrical power generated by the single steam turbine generator is sufficient to drive said ammonia refrigeration system.

21. The system according to claim 18, wherein said ammonia refrigerant comprises low temperature ammonia provided by an ammonia refrigeration packages.

22. The system according to claim 21, wherein the ammonia refrigeration packages is cooled by air coolers.

23. The system according to claim 18, wherein the system comprises a cooler to cool the compressed mixed refrigerant prior to the compressed mixed refrigerant being received in said exchanger.

24. The system according to claim 23, wherein the cooler is an air-cooled heat exchanger, or a water-cooled heat exchanger.

25. The system according to claim 18, wherein the hydrocarbon liquid exiting the third main heat exchange pathway is expanded through an expander to further cool the hydrocarbon liquid.

26. The process according to claim 1, further comprising pre-cooling the hydrocarbon gas prior to passing the hydrocarbon gas through said heat exchanger.

27. The process according to claim 26, comprising pre-cooling the hydrocarbon gas with the ammonia refrigerant.

28. The process according to claim 1, wherein the steam generator provides steam to heat and regenerate one or more of a CO2 stripping plant, molecular sieves of a dehydration plant, regeneration gas and fuel gas.

29. The process according to claim 1, wherein the mixed refrigerant provides composite cooling and heating curves to within about 2°.

* * * * *